US005219393A

United States Patent [19]

Niederstadt et al.

[11] Patent Number: 5,219,393

[45] Date of Patent: Jun. 15, 1993

[54] PRESSURE DRIVEN ROTARY DRIVE

[75] Inventors: Jörg Niederstadt, Schramberg; Ralf Huber, Brigachtal, both of Fed. Rep. of Germany

[73] Assignee: Mannesmann Aktiengesellschaft, Dusseldorf, Fed. Rep. of Germany

[21] Appl. No.: 861,228

[22] Filed: Mar. 31, 1992

[30] Foreign Application Priority Data

Apr. 3, 1991 [DE] Fed. Rep. of Germany ..... 4111116

[51] Int. Cl.[5] ..... F01B 25/26; F01B 31/12

[52] U.S. Cl. ..... 91/1; 91/361; 91/459; 92/89; 92/59; 92/111

[58] Field of Search ..... 91/361, 459, 275, 1; 92/111, 89, 90, 91, 92, 150, 151, 59, 128; 188/157, 158, 162

[56] References Cited

U.S. PATENT DOCUMENTS

| | | | |
|---|---|---|---|
| 2,664,859 | 1/1954 | Green | 92/111 |
| 2,939,283 | 6/1960 | Ashton | 91/459 |
| 2,944,520 | 7/1960 | Swanson | 92/151 |
| 3,288,036 | 11/1966 | Fisher | 92/151 |
| 4,838,148 | 6/1989 | Denker | 92/90 |
| 4,841,843 | 6/1989 | Shishkin et al. | 91/459 |

FOREIGN PATENT DOCUMENTS

| | | | |
|---|---|---|---|
| 0176833 | 7/1988 | Japan | 188/157 |
| 0746132 | 7/1980 | U.S.S.R. | 91/459 |

*Primary Examiner*—Thomas E. Denion

*Attorney, Agent, or Firm*—Cohen, Pontani, Lieberman, Pavane

[57] ABSTRACT

A hydraulically operated rotary drive includes a housing which is closed in hydraulically tight manner by flat covers and can be connected to a source of pressure fluid, a rotatable shaft extending through the covers out of the housing and a belt which is arranged at least in part within the housing with the formation of movable pressure chambers and is operatively connected to the shaft. In order to create a rotary drive which permits any desired extension to external structural groups as well as a modular extension to a plurality of rotary drives, it is proposed that axially extending channels (2, 2') for receiving and forwarding the pressure fluid to the pressure chambers and electrical connections be integrated within the shaft and that the shaft (3) be provided on both axial ends with coupling elements for the coupling outside the housing of mechanical and/or electrical attachment modules which can be coupled to the rotary movement.

13 Claims, 3 Drawing Sheets

PRESSURE DRIVEN ROTARY DRIVE

BACKGROUND OF THE INVENTION

1. Field of the Invention

The present invention relates to a hydraulically operated rotary drive including a housing which can be connected to a source of pressure fluid, a rotatable shaft, and a belt which is arranged at least partially within the housing with the formation of movable pressure chambers and is functionally connected to the shaft.

2. Description of the Related Art

A hydraulically operated rotary drive of this type is known from U.S. Pat. No. 4,838,148. In that known rotary drive, a flexible belt is arranged within a housing having a hollow space and forms movable pressure chambers within the housing. These movable pressure chambers are formed by the provision of rollers or roller-shaped bodies within the housing, over which the belt is passed, forming at least one open loop. The movable pressure chambers 14 are constructed and operate in the manner disclosed, for example, in above-mentioned U.S. Pat. No. 4,838,148. Thus, the shaft 3 is rotated by the belt 15 when pressure fluid is admitted to one of the chambers 14.

The belt is movable within the hollow space in such a manner that by its revolving it changes the open region of the loop which forms the pressure chambers. This change is effected in the final analysis by the pressure fluid introduced into the movable pressure chambers. The two outer edges of the belt rest in the housing or in the hollow space in such a manner that, on the one hand, it is still readily movable while, on the other hand, it seals in hydraulically tight manner. The change or movement of the belt effected by the impact of pressure with the formation of the aforementioned open loop results, upon travel over the rotatable roller arranged within the housing, in a rotary movement which can be tapped off. This rotary movement is conducted outward via a shaft. This known development has the disadvantage that it cannot readily be extended to mechanical or mechanico-electrical structural groups. The difficulty in such external extension is not solely the mechanical coupling but also the effecting of electrical connections and connections of pressure fluid from one structural part or module to the other.

SUMMARY OF THE INVENTION

The object of the present invention is therefore, proceeding from this prior art, to create a rotary drive which permits extension as desired to external structural components as well as modular extension to a plurality of rotary drives.

This object is achieved in accordance with the invention in a hydraulically operated rotary drive of this type by providing channels integrated within the shaft extending in axial direction for receiving and further conducting the pressure fluid to the pressure chambers and for electric lines. The shaft is provided on both axial ends thereof with coupling elements for externally coupling thereto mechanical and/or electrical attachment modules for rotation with the shaft.

The advantages of the hydraulically operated rotary drive proposed by the invention result from the suitable adaptation to each other of different features which, as a whole, permit simple modular extension of the rotary drive to external structural groups or modules. The integrated passage of the pressure fluid and of the electric lines is particularly advantageous. The integration of the pressure-fluid channels in the shaft of the rotary drive, as well as the integrating of the switch valves and servovalves in one of the covers, leads to a compact construction. In order now suitably to connect the channels conducting pressure fluid which are arranged integrated in the shaft to the switch valves and the outwardly extending pressure-fluid connections in suitable manner, the shaft is provided, in at least one of the cover regions, with holes which extend radially out of the shaft and are connected in gas-tight manner with the channels conducting the pressure fluid. In order furthermore to connect these holes in gas-tight manner with the switch valves and pressure-fluid connections, circumferential grooves are provided on the shaft, they being connected in gas-tight manner with the channels conducting the pressure fluid. These grooves, in their turn, are connected in gas-tight manner via integrated channels with the switch valves and with pressure-fluid connections which extend towards the outside. In order to obtain the desired tightness, the shaft is furthermore provided with a plurality of annular depressions which are axially offset from the grooves and into which sealing rings for the sealing off of the grooves are arranged. Thus, in this embodiment, despite the rotation of the shaft, a suitably tight hydraulic connection is obtained in particularly advantageous manner between the stationary cover and the connections and switch valves integrated therein and the rotatable shaft which contains the channels.

The servovalves integrated in the cover serve in a simple and compact construction for the action of pressure fluid on the pressure chambers formed by the belt within the housing.

In order to obtain a high torque which can be tapped off from the outside, a plurality of rotary drives can be connected to each other. For this also, the developments in accordance with the invention are extremely advantageous since the channels which conduct the pressure fluid and electric lines are integrated in the shaft and possibly even connected from one rotary drive to the other. In connection herewith, it is furthermore advantageous to develop the coupling elements on the axial ends of the outward extending shaft as driver connections in accordance with the tongue-and-groove principle. Thus, by this development, any type of external coupling is prepared for and therefore can be effected rapidly. It is furthermore advantageous here to provide the rotary drive in this modular manner with an angle-of-rotation transmitter which converts the exact position of rotation of the shaft of the rotary drive into an electric signal, as a result of which the electric line can be passed through the shaft here in a particularly simple manner. Furthermore, the rotary drive can, as proposed in the invention, be expanded by a brake module in order, for instance, to assure a dependable rotational positioning upon rapid rotary movements or even to obtain a gripping movement in precise position upon use of a gripper element. In such case, the brake can furthermore relieve the rotary drive in the manner that, in the end position of the gripper, the gripping pressure of the gripper elements can be obtained not by the action of pressure fluid in the rotary drive but by the application of the brakes in the brake module.

DESCRIPTION OF THE PREFERRED EMBODIMENT

Figure 1:
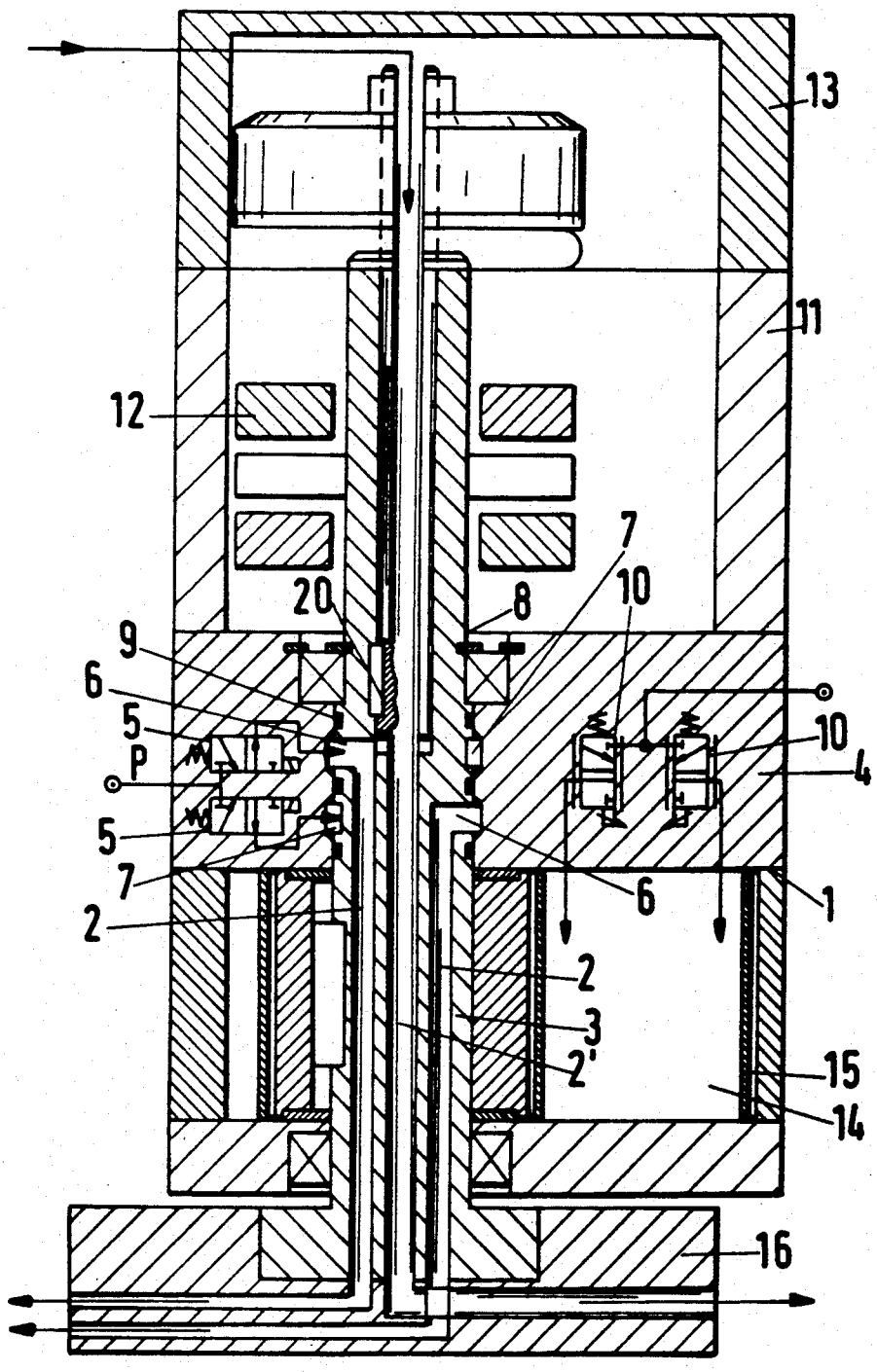
FIG. 1 shows the rotary drive with modularly expanded brake module and angle-of-rotation transmitter.

FIG. 1 shows an embodiment of the invention in which a rotary drive 1 with integrated channels 2, 2' in the shaft 3 which conduct pressure-fluid and electric lines is shown. Here the actual rotary drive is shown thickened in one of the cover regions 4 and provided there with integrated switch valves 5 and the corresponding connections to the pressure-fluid lines 2. The axially extending channels 2 in the shaft are connected in hydraulically tight manner with the corresponding radially extending holes 6 in the region of the cover 4 which contains the switch valves 5. These radially extending holes open into the grooves 7 which are arranged annularly in the guide hole 8 which guides the shaft 3 towards the outside. Since the shaft 3 is secured against axial displacement, there is assurance in every operating situation that the corresponding hole 6, and thus the corresponding pressure-fluid channel 7, are in communication in a hydraulically tight manner with the intended groove. For the hydraulically tight sealing on the one hand of the grooves with respect to each other and of the grooves within or outside the housing, the shaft 3 is provided with the corresponding annular depressions 9 in which sealing rings are arranged. These sealing rings lie in the corresponding depression of the shaft and at the same time press against the wall of the guide hole 8 so that the corresponding tight closure is produced in this way. In this embodiment, both switch valves 5 and servovalves 10 are arranged within the cover 4. The servovalves 10 are connected with an outwardly conducted pressure-fluid supply connection P and furthermore open at suitable places into the movable pressure chambers 14 formed by the belt 15. The switch valves 5 are also connected to an outwardly extending pressure-fluid supply connection P.

The pressure-fluid channels 2 in the shaft 3 are in this embodiment led outward through a force-transmitting rotary plate 16 arranged on one of the ends of the shaft but they can, for instance, simply emerge from the shaft and be conducted to another rotary drive which, in its turn, is connected on the shaft side to the channels in such a manner that separate valves and separate pressure-fluid connections can be dispensed with in the case of this further rotary drive. In other words, the pressure-fluid channels can be connected in this way from one module to the other. In this way, a very simple and compact extension of the rotary drive results. In this embodiment, the rotary drive 1 is connected to a brake module 11 which is coupled to the shaft 3 of the rotary drive 1 via coupling elements 20, 21 based on the tongue-and-groove principle. The shaft arranged in the brake module 11 is in this connection provided with a disk brake 12. Both the shaft of the rotary drive and the shaft of the brake module are connected with a widenable channel 2' which extends from one module to the other and which, in this example, is intended for the passage of electrical lines. The angle-of-rotation transmitter 13, which is also coupled via the tongue-and-groove principle above the brake module 11, operates here as rotary potentiometer, the electric lines for the tapping off of the signal being possibly passed through the corresponding channel up to the other end of the shaft which emerges from the entire structural group.

Figure 2:
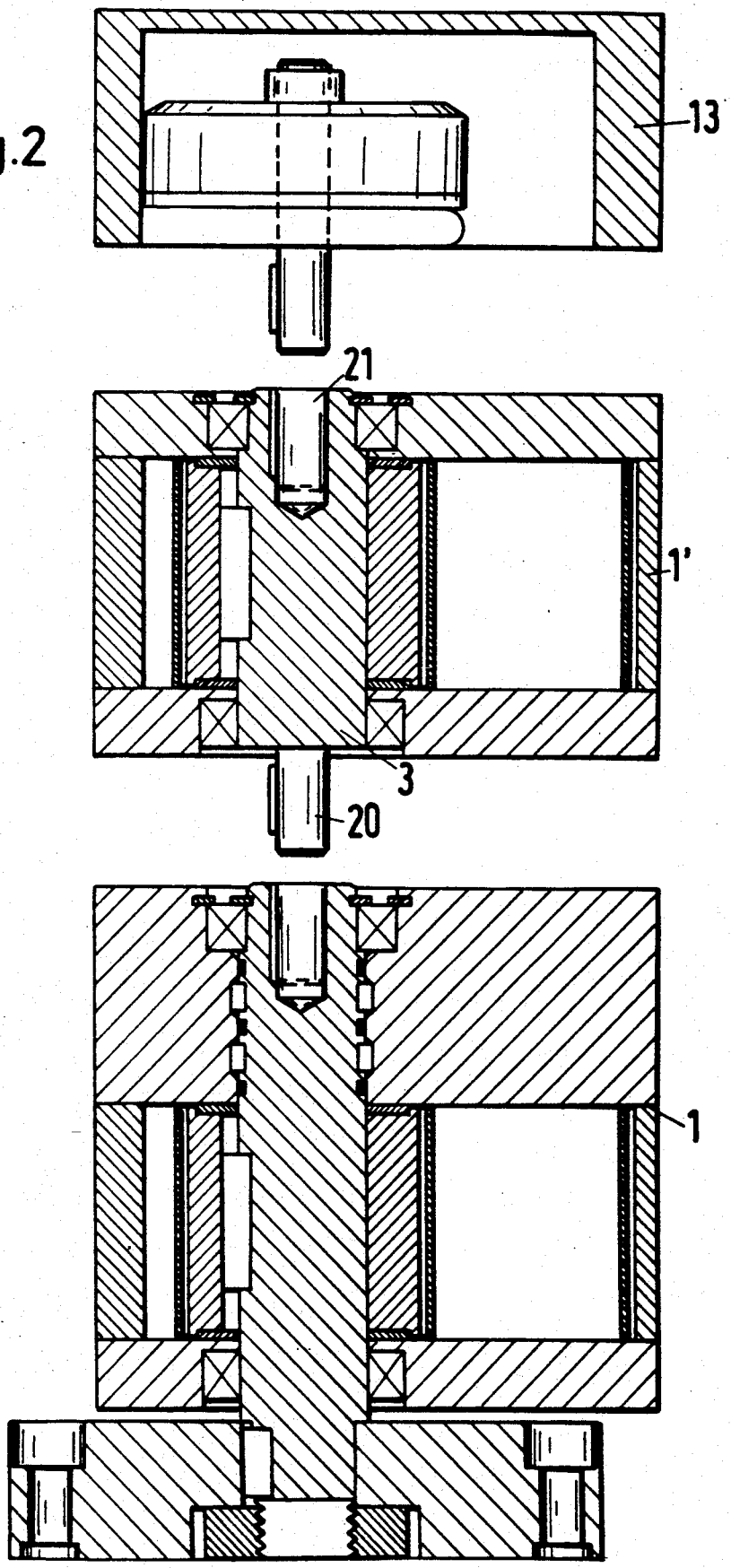
FIG. 2 shows the structural group consisting of two rotary drives and an angle-of-rotation transmitter, shown in assembly position.

FIG. 2 shows an embodiment in which the coupling of two rotary drives 1, 1' is shown, the additional rotary drive 1' being adapted to be connected to the other rotary drive 1 without separate valves and pressure-fluid connections. The feeding of the rotary drive 1' without separate connections and valves is effected via the continuing of the channels from one module to the other, as already described in connection with FIG. 1. By the use of two rotary drives here, twice the torque can be tapped off on the outside from the shaft. This torque can be multiplied by arranging as many rotary drives as desired one behind the other. The coupling elements 20, 21 on the axial ends of the shaft 3, which coupling elements are developed in accordance with the tongue-and-groove principle, can be clearly noted here. It has been found advantageous in this connection that, at each of the rotary drives, the coupling elements 20, 21 at the axial ends of the shaft 3 be developed on the one end in pin-like manner as tongue-and-groove and that, accordingly, the other axial end of the shaft be provided with a hole with the corresponding tongue-and-groove contour which receives such a tongue-and-groove pin. In this way, a simple arrangement one behind the other is possible.

Figure 3:
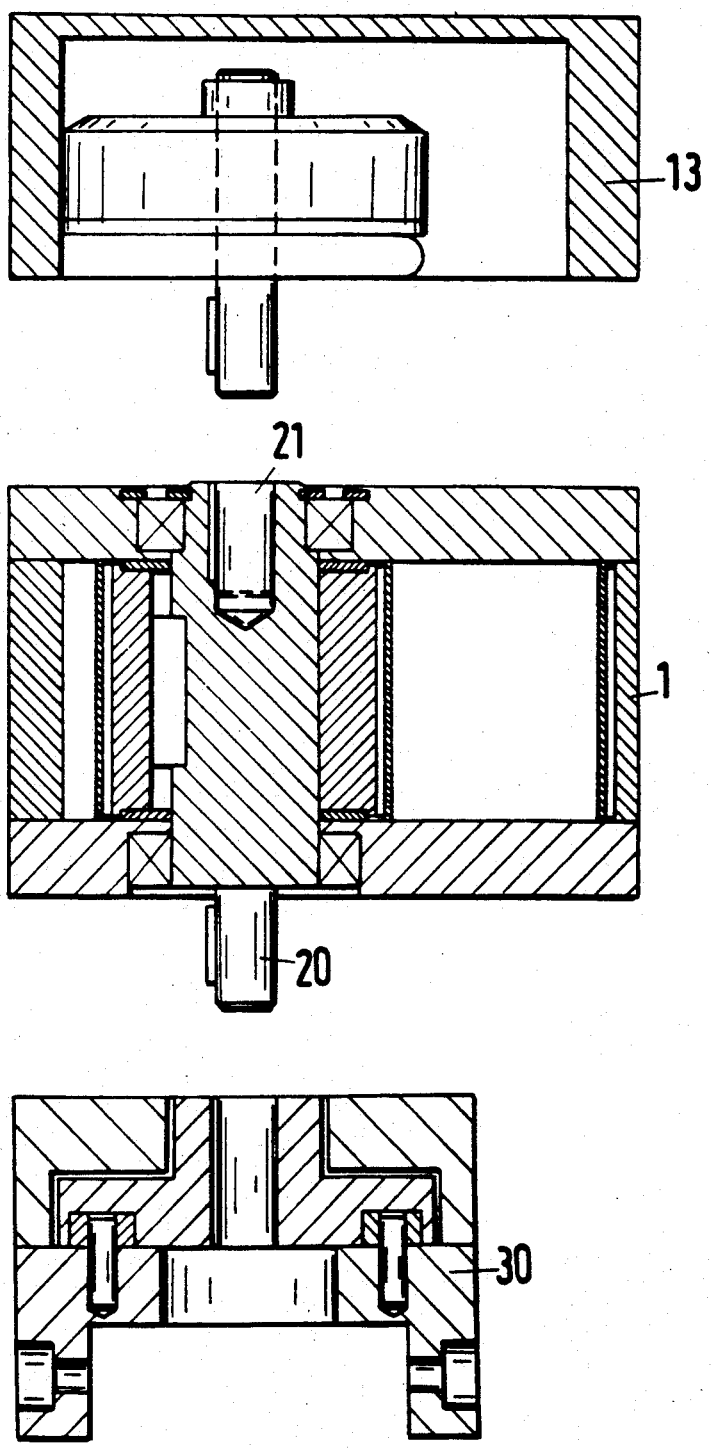
FIG. 3 shows the rotary drive with gripper and angle-of-rotation transmitter.

FIG. 3 shows an embodiment in which a rotary drive 1 is provided for coupling to a gripper 30. In this case, the rotary drive needs no other than the previously indicated coupling elements 20, 21 in order to effect this. This means, as a whole, that all extension modules are so adapted to each other that the coupling elements 20, 21 will always fit each module.

We claim:

1. A hydraulically driven rotary drive comprising a housing and flat covers for closing the housing in a pressure-tight manner, a rotatable shaft having an axis and axial ends, the shaft extending through the covers and projecting out of the housing, a belt in operational connection with the shaft, the belt being mounted at least partially within the housing and defining movable pressure chambers, the shaft defining axially extending channels for receiving electric lines and for conducting pressure medium to the pressure chambers, the shaft having at both axial ends thereof coupling means for connecting externally of the housing attachment modules to the shaft, such that the attachment modules rotate with the shaft when the shaft is rotated.

2. The rotary drive according to claim 1, wherein the shaft defines adjacent at least one of the covers radial bores which radially emerge from the shaft and are connected in a gas-tight manner to the channels for conducting the pressure medium, the cover defining a guide bore for guiding the shaft projecting out of the housing, the guide bore defining circumferential grooves which are in pressure-tight communication with the channels for conducting the pressure medium.

3. The rotary drive according to claim 2, comprising switch valves integrated within the cover, the cover having outward connections, the cover defining integrated connection channels for connecting the switch valves in a pressure-tight manner to the circumferential grooves and to the outward connections.

4. The rotary drive according to claim 3, wherein the shaft has a plurality of annular depressions which are arranged axially offset relative to the circumferential grooves, sealing rings being mounted in the annular depressions for tightly sealing the circumferential grooves.

5. The rotary drive according to claim 1, comprising several valves integrated in the cover, the cover having outward connections, the cover defining integrated connection channels for connecting the several valves to the pressure chambers and to the outward connections in a pressure-tight manner.

6. The rotary drive according to claim 1, wherein the coupling means comprise a tongue-and-groove-type driving connection.

7. The rotary drive according to claim 1, comprising at least another rotary drive coupled to the rotary drive.

8. The rotary drive according to claim 1, comprising an angle-of-rotation transmitter coupled to the rotary drive.

9. The rotary drive according to claim 8, wherein the electric lines received in the axially extending channel extend through the shaft to electrical connection lines of the angle-of-rotation transmitter.

10. The rotary drive according to claim 1, comprising a brake module coupled to the rotary drive.

11. The rotary drive according to claim 1, comprising a gripper module for transforming the rotary movement into a central gripper movement.

12. The rotary drive according to claim 1, wherein the coupling means is configured for connecting mechanical attachment modules to the shaft.

13. The rotary drive according to claim 1, wherein the coupling means is configured for connecting electrical attachment modules to the shaft.

* * * * *